United States Patent [19]

Moustakas

[11] 3,961,439

[45] June 8, 1976

[54] PICTORIAL AMUSEMENT DEVICE

[75] Inventor: Matthew A. Moustakas, Mercerville, N.J.

[73] Assignee: CBS Inc., New York, N.Y.

[22] Filed: Aug. 21, 1975

[21] Appl. No.: 606,664

[52] U.S. Cl. ..... 46/22; 273/153 R

[51] Int. Cl.[2] ..... A63H 3/16

[58] Field of Search ..... 46/16, 22; 35/69; 273/153, 155

[56] References Cited

UNITED STATES PATENTS

| | | | |
|---|---|---|---|
| 211,528 | 1/1879 | Shelton | 46/22 |
| 408,148 | 7/1889 | Throop | 273/153 R |
| 3,302,311 | 2/1967 | Israel | 35/69 |

*Primary Examiner*—Louis G. Mancene
*Assistant Examiner*—Robert F. Cutting
*Attorney, Agent, or Firm*—Spencer E. Olson

[57] ABSTRACT

A pictorial amusement device for children consisting of two cooperating parts, a generally cubical block having four side surfaces and top and bottom surfaces, the side surfaces having representations thereon of a human figure from the shoulders down in four different attires depicting different human activities, and a cylindrical block dimensioned to be received in a central socket in the top surface of the cubical block. The cylindrical block has a length approximately twice the depth of the socket, approximately half of which has a representation on the outer surface thereof of a human head with a smiling face and the other half of which has a representation of a human head with a frowning face, the smiling and frowning faces being inverted relative to each other. The cylindrical block may be reversibly placed in the socket so as to depict, in cooperation with a representation on a side surface of the cubical block, a human with either a smiling face or a frowning face, and may be rotated in the socket so as to associate the face with a selected one of the four depicted "body" figures.

6 Claims, 5 Drawing Figures

PICTORIAL AMUSEMENT DEVICE

BACKGROUND OF THE INVENTION

This invention relates to amusement devices for children and, more particularly, to a toy of novel structure which admits of the presentation, by selective manipulation by the user, of a three-dimensional representation of a human figure in such a manner as to admit of one of the parts of the toy being positioned relative to the other part so as to change the general character of the representation.

Toys of a pictorial nature and by which parts of a human figure, animal, flowers, landscapes, or other pictorial representations may be varied to secure a large number of pictorial effects have long been known and available in a variety of configurations. For example, in the case of the representation of a human figure, the clothing, parts of the body, and other elements associated therewith may be varied at will so that the aspect of many different figures will be had in an amusing manner. Representative of this type of toy is the device described in U.S. Pat. No. 2,931,657 which has a cylindrical body provided with a window opening in its side wall and enclosing a plurality of separately rotatable cylindrical sections arranged coaxially and for selective exposure of their outer faces within the window. As a result, the rotative movement of these cylindrical sections will position various pictorial elements in the window and in such assembled relationship that a unitary picture or figure will be the result. By selective rotation of the several cylindrical sections, a large number of different figures may be produced. Although this type of toy permits the composition by the user of a large number of different figures, some of which are amusing by virtue of the unnaturalness of the composite picture, the toy does not, because most of the pictorial elements on all of the cylindrical sections are hidden from view, permit the child to visualize in advance the representation he would like to create; rather, each of the cylindrical sections must be separately rotated until the pictorial elements assembled in the viewing window produce a composite picture, which may or may not achieve the representation that the child had in mind.

A primary object of this invention is to provide a simple and inexpensive toy of this general nature which is so simple to operate that it can be used by a small child, yet sufficiently sophisticated that an older child, say, up to six years of age, will continue to use it with interest. More particularly, the toy according to the invention permits the child to visualize in advance the one of several possible pictorial effects he wishes to represent and then by proper manipulation of the parts of the toy, produce that effect.

Another object of the invention is to provide a toy of this type which can be made strong enough to withstand rough handling and which meets the strict standards of safety and cleanliness to which toys are subject.

SUMMARY OF THE INVENTION

Briefly, the pictorial toy in accordance with this invention consists of two simple, inexpensive parts, a generally cubical block, preferably formed of wood, having on the four side surfaces thereof representations of a human figure from the shoulders down, in four different attires depicting four different human activities, and having a central socket in the upper surface of the block into which a generally cylindrical block may be reversibly placed at the option of the user. The cylindrical block has a length of about twice the depth of the socket, and approximately half of the length of which, including one end thereof, has a representation thereon of a human head with a first distinctive facial expression, say smiling, and the other half of the length of which, including the other end has a representation thereon of a human head with a second distinctive facial expression, say frowning. One of the "faces" on the cylindrical block is inverted relative to the other such that when it is reversibly placed in the socket, the representation thereon, in cooperation with a representation of a side surface of the cubical block, depicts a human figure with either a smiling face or a frowning face. The cylindrical block can also be rotated in the socket so as to associate a selected face with a selected one of the four depicted "body" figures.

In the preferred embodiment, both parts of the toy are formed of wood, and the various representations are printed in color on paper secured to appropriate surfaces of the two wooden members. The toy, even in the hands of an infant, is perfectly harmless, is washable, and is relatively inexpensive to manufacture.

BRIEF DESCRIPTION OF THE DRAWINGS

Further features and advantages of the invention will become more readily apparent from the following detailed description when taken in conjunction with the accompanying drawings, in which.

DESCRIPTION OF THE PREFERRED EMBODIMENT

Figure 1:
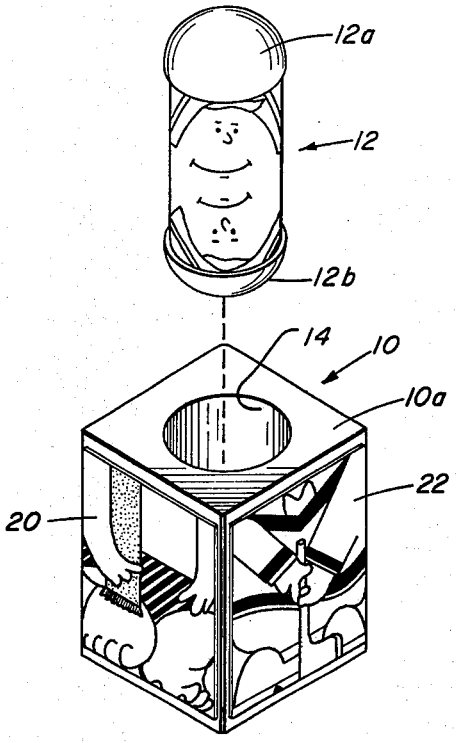
FIG. 1 is an exploded perspective view of the amusement device.

Referring to the drawings, the toy according to the invention consists of two structural parts, a generally cubical block 10 and a cylindrical block 12, both preferably formed of wood. Typically, the cubical block is 1 5/16 inch high and each of its side surfaces has a width of 1¼ inch, so as to be readily handled by a small child. The four vertical edges of the block are preferably chamfered to improve appearance, wearability and for safety reasons. A central socket 14, typically ⅞ inch in diameter and 15/16 inch deep is formed, as by drilling, in the upper surface 10*a* of the cubical block, and a socket 16, also ⅞ inch in diameter and 5/16 inch deep is formed in the lower surface 10*b* of the block. These dimensions are such as to provide a 3/16 inch thick platform 18 within the block. The cylindrical block 12 typically has a length of 1⅞ inches, twice the depth of the socket 14, and a diameter of 13/16 inch so as to be loosely received in the socket. Both of its ends 12*a* and 12*b* are rounded so as to give a semblance of the shape of a human head, and has a recess, typically 1/32 inch deep, in its outer surface for aout 1⅛ inches of its length.

Figure 2:
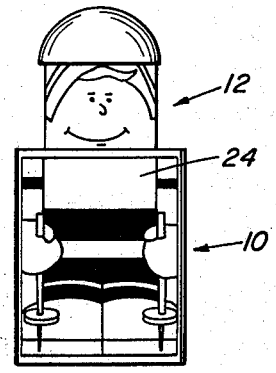
FIG. 2 is an elevation view of the device showing the cylindrical block in position in the socket in the cubical block and illustrating the representation on a side surface not visible in FIG. 1.

The four side surfaces of block 10 have thereon representations of a human figure from the shoulders down in four different attires depicting different human activities, two of which are visible in FIG. 1. The illustrated representations depict attires and activities of an adult male, the representation 20 showing him in swim trunks with a towel over his shoulder, and representation 22 showing him in golf togs and holding a golf club. In FIG. 2, which shows the representation 24 on one of the side surfaces not visible in FIG. 1, he is dressed in ski clothing and is holding a pair of ski poles, and in FIG. 3, which shows the other side surface 26 not visible in FIG. 1, he is dressed in a business suit and is carrying a briefcase and a document. In the preferred embodiment, the representations 20, 22, 24 and 26 are printed on paper in several colors, and the paper is affixed to the side surfaces of the block with a suitable adhesive. The area of the individual labels is preferably slightly less than the area of a side surface of the block so as to expose the chamfered vertical edges of the block and narrow strips of wood both above and below each of the panels; this construction minimizes the possibility of peeling of the labels from the block and improves the esthetic appearance of the toy.

As best seen in FIG. 1, the recessed area of the cylindrical block 12 has thereon a representation of two faces, one of which is inverted relative to the other, the upper half representing a smiling face, and the lower half being an inverted representation of a frowning face. In both cases, the face is surrounded with a representation of the hair of an adult male, the faces occupying approximately one-half the circumferential area of the cylinder with the other half (not visible in any of the figures) being essentially fully covered with a representation of groomed human hair. In the preferred embodiment, the representations of the faces are printed in color on a single piece of paper and the paper is secured to the recessed area with a suitable adhesive. The exposed rounded ends of the cylindrical block, together with the cylindrical recess, give the appearance of a rounded hat covering the hair.

The cylindrical block is loosely insertable in the socket 14, and being twice as long as the depth of the socket, only one of the faces is visible when the cylindrical block is in place in the socket. Thus, when the cylindrical block is inserted with the smiling face in the upright position, the smiling face associates with the body representation with which it is aligned. Conversely, when the cylindrical block is reversed from the position shown in FIGS. 1 and 2 and inserted in the socket, the resulting representation has a frowning face. It is evident that the four different side panels and the two possible positions of the cylindrical block provide eight different possible combinations of face and body, allowing considerable latitude for the imagination of the child in associating facial expression with the activity depicted by the attire. For example, and as is suggested by the drawings, a child might well associate the smiling facial expression with the depicted leisure activities of swimming, golfing and skiing, and, having observed his father when he leaves for work in the morning, might associate the frowning face with the business suit, as illustrated in FIG. 3.

Although the invention has been described by way of example as depicting facial expressions and activities of an adult male, in the commercial exploitation of the toy the illustrated configuration is but one of a "family" of "block people" which includes in addition a female adult (mother), a boy and a girl. The side surfaces of the cubical block for each of the other three members of the family have representations of attire and activity unique to a mother, a son and a daughter, and the representation of the faces on the cylindrical block (in all cases, a smiling face and a frowning face) are sufficiently distinctive in terms of hair, coloring and facial detail as to be distinguished by a discerning child so as to enable him to associate a given one of the four "heads" with the appropriate one of the four "bodies" of the set. Thus, in addition to giving the child an opportunity to associate facial expressions with different activities, a set of the toys adds another dimension to the process of correctly associating the representations depicted on the eight different pieces. That is, a set of four "people" takes on the characteristics of a puzzle, calling for correctly associating each of the four heads with the proper body, this to be followed by a desired association of facial expression with the activities depicted by the attires on each of the blocks.

Figure 3:
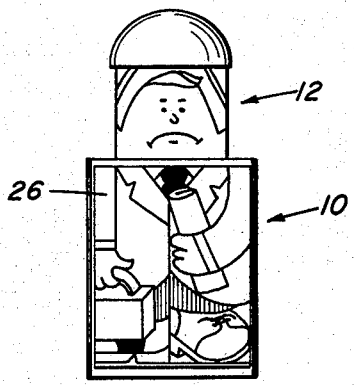
FIG. 3 is an elevation view showing the representation on the other side surface not visible in FIG. 1 and illustrating the cylindrical block in a position reversed from that shown in FIG. 2.
Figure 4:
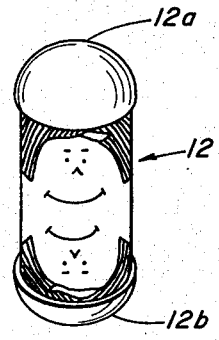
FIG. 4 is a perspective view of a cylindrical block having thereon representations of a female face.
Figure 5:
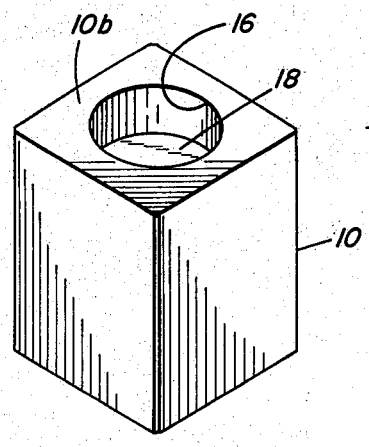
FIG. 5 is a perspective view of the cubical block illustrating the construction of the bottom surface thereof.

FIG. 4 is a perspective view of a cylindrical block having markings thereon differing from the markings of the block shown in FIGS. 1–3, primarily in the arrangement of the "hair" and the shape of the nose, so as to represent the head of a female. With further changes in the markings, particularly in the arrangement and coloring of the hair, it is possible to provide two other "heads" for a boy and for a girl, which are distinguishable from each other and from the adult male head of FIG. 1 and the adult female head of FIG. 4.

To give this toy greater interest and utility, it is intended for sale in sets of four along with other devices which are symbolically associated with at least some of the activities depicted by the attires represented on the blocks, such as vehicles of various kinds (e.g., a car, a boat or a ski slide) in which one or more of the "family" of blocks may be placed. The shallow socket 16 in the under surface of the cubical block engages an upstanding stud of corresponding height on the vehicle to retain the "block person" in place on the vehicle.

I claim:

1. A pictorial amusement device comprising:

a generally cubical block having four side surfaces and top and bottom surfaces, said side surfaces having representations thereon of a human body from the shoulders down in four different attires depicting different activities, and having a central socket in said top surface of predetermined depth, and a cylindrical block of length about twice the depth of said socket and having a diameter so as to be loosely received in said socket, approximately half of the length of the outer surface of said cylindrical block from one end thereof having a representation thereon of a human head with a first facial expression and the other half of the length of the block from the other end thereof having a representation thereon of a human head with a second facial expression, the face of one of the heads being inverted relative to the other face, said cylindrical block being reversibly insertable in said socket so as to depict, in cooperation with the representation on one of the side surfaces of the cubical block, a human with either said first or said second facial expression, and rotatable in the socket so as to associate the selected facial expression with a selected one of the four depicted bodies.

2. A pictorial amusement device according to claim 1, wherein the side surfaces of the cubical block are covered with paper having said representations printed thereon.

3. A pictorial amusement device according to claim 1, wherein at least a portion of the outer surface of said cylindrical block is covered with paper having said representations of a human head printed thereon.

4. A pictorial amusement device according to claim 3, wherein the ends of said cylindrical block are rounded, and wherein that portion of the cylindrical block between the rounded ends is recessed and said recessed portion is covered with paper having said representations of a human head printed thereon.

5. A pictorial amusement device according to claim 1, wherein said cubical block and said cylindrical block are both formed of wood.

6. A pictorial amusement device according to claim 1, wherein said first facial expression is a smile and said second facial expression is a frown, and wherein the smiling and frowning faces are aligned with each other along the length direction of said cylindrical block and occupy approximately one-half the circumferential area of the block.

* * * * *